United States Patent [19]

Smith

[11] 4,301,930

[45] Nov. 24, 1981

[54] DISK SCREEN, MODULAR DISK ASSEMBLY AND METHOD

[75] Inventor: William C. Smith, West Vancouver, Canada

[73] Assignee: Radar Companies, Inc., Portland, Oreg.

[21] Appl. No.: 78,190

[22] Filed: Sep. 24, 1979

[51] Int. Cl.[3] ..... B07B 13/05

[52] U.S. Cl. ..... 209/671; 209/672; 209/233; 209/361; 228/212

[58] Field of Search ..... 209/233, 361, 671, 672; 228/212; 29/281.5

[56] References Cited

U.S. PATENT DOCUMENTS

| | | | |
|---|---|---|---|
| 893,905 | 7/1908 | Dodge | 209/361 |
| 1,418,899 | 6/1922 | Acken | 209/671 |
| 1,948,818 | 2/1934 | Kettering | 228/212 X |
| 2,266,506 | 12/1940 | Morse | 209/671 |
| 2,442,446 | 6/1948 | Wallace | 228/212 X |
| 2,743,813 | 5/1956 | Erickson | 209/672 X |
| 3,306,441 | 2/1967 | Sanders | 209/672 X |
| 3,837,061 | 9/1974 | Hirose | 29/281.5 X |
| 3,870,627 | 5/1975 | Herkes | 209/233 X |
| 4,037,723 | 7/1977 | Wahl | 209/361 X |
| 4,239,119 | 12/1980 | Kroell | 209/361 X |

FOREIGN PATENT DOCUMENTS

| | | | |
|---|---|---|---|
| 924266 | 3/1947 | France | 209/672 |
| 423519 | 9/1974 | U.S.S.R. | 209/233 |

*Primary Examiner*—Robert Halper

*Attorney, Agent, or Firm*—Hill, Van Santen, Steadman, Chiara & Simpson

[57] ABSTRACT

In a disk screen apparatus of the type having a series of corotating shafts, each of which has a longitudinal series of concentric screen disks which mesh with the screen disks of the adjacent shafts, the screen disks are carried by tubular modules mounted in end-to-end relation on the shafts. Each module comprises a tubular hub having a set of centrally apertured screen disks concentrically mounted in radially extending relation on the hub, which projects through the central apertures of the disks, the disks being attached to the hub in substantially accurately spaced relation to one another axially along the hub. A method is provided for making the modules, and also for making a disk screen apparatus embodying the modules.

14 Claims, 6 Drawing Figures

DISK SCREEN, MODULAR DISK ASSEMBLY AND METHOD

Disk screens are desirable apparatus in the paper pulp industry for screening large flows of chips to remove chips over certain desired dimensions. Such screens comprise a screening bed having a series of corotating spaced parallel shafts each of which has a longitudinal series of concentric screen disks which interdigitate with the screen disks of the adjacent shafts. The spaces between the disks permit only material of acceptable size to pass downardly through the rotating disk bed, and since the disks are all driven to rotate in common direction from the infeed end of the screen bed to the outfeed or discharge end of the bed, the particles of material which are larger than the acceptable sizes of material will be advanced on the bed to the outfeed end of the bed and rejected.

One of the problems with such disk screens has been thatbecause of the large number of disks on any shaft, even slight variations in manufacturing tolerances have been detrimental to slot width from one side of the screen bed to the other side of the screen bed. In order to attain fairly uniform slot widths, a tremendous amount of hand-fitting has heretofore been required. Such hand-fitting has been found to be unpredictable as to results, time consuming and expensive. The problem is aggravated where quite narrow slot widths are required. This problem is serious enough where the slot width defined by the disks is on the order of 10 mm. However, industry demands have aggravated the problem by demanding narrower slot widths, such as 8 mm and 5 mm. It is to the alleviation of this problem that the present invention is primarily directed.

An important object of the present invention is to provide a new and improved disk screen apparatus which will overcome the disadvantages, drawbacks, inefficiencies, shortcomings and problems inherent in prior such apparatus.

Another object of the invention is to provide a new and improved disk screen apparatus in which the screen disks are organized in a novel module arrangement.

Another object of the invention is to provide a new and improved screen disk module structure.

Still another object of the invention is to provide a new and improved method of making a disk screen apparatus embodying screen disk modules.

Still another object of the invention is to provide a method of making screen disk modules adpated to be mounted with like modules in assembly in a disk screen apparatus.

The invention provides a disk screen apparatus comprising a screening bed having a series of corotating spaced parallel shafts each of which has a longitudinal series of concentric screen disks which interdigitate with the screen disks of the adjacent shafts, and comprising each of said shafts carrying concentrically thereon a plurality of tubular screen disk modules in end-to-end relation, and each module comprising a tubular hub carrying in radially extending relation thereon a set of said disks in substantially accurately spaced relation to one another axially along said hub.

The invention also provides a screen disk module adapted to be mounted with like modules in end-to-end assembly on a shaft in disk screen apparatus, said module comprising a tubular hub adapted for engagement on and about the disk screen shaft, a set of centrally apertured screen disks concentrally mounted in radially extending relation on said hub which projects through the central apertures of the disks, and means attaching said disks to said hub in substantially accurately spaced relation to one another axially along said hub.

According to the invention, there is also provided a method of making a disk screen apparatus comprising a screening bed having a series of corotating shafts each of which has a longitudinal series of concentric screen disks which interdigitate with the screen disks of the adjacent shafts, the method comprising providing a plurality of tubular screen disk modules each of which comprises a tubular hub carrying in radially extending relation thereon a set of said disks in substantially accurately spaced relation to one another axially along said hub, and mounting said modules in end-to-end relation on said shafts.

There is also provided by the present invention, a method of making a screen disk module adapted to be mounted with like modules in end-to-end assembly on a shaft in disk screen apparatus, the method comprising providing a tubular hub adapted for engagement on and about the disk screen shaft, providing a set of centrally apertured screen disks and mounting said disks concentrically and in radially extending relation on said hub which projects through the central apertures of the disks, and attaching said disks to said hub in substantially accurately spaced relation to one another axially along said hub.

Other objects, features and advantages of the invention will be readily apparent from the following description of certain representative embodiments thereof, taken in conjunction with the accompanying drawings although variations and modifications may be effected without departing from the spirit and scope of the novel concepts embodied in the disclosure and in which.

Figure 1:
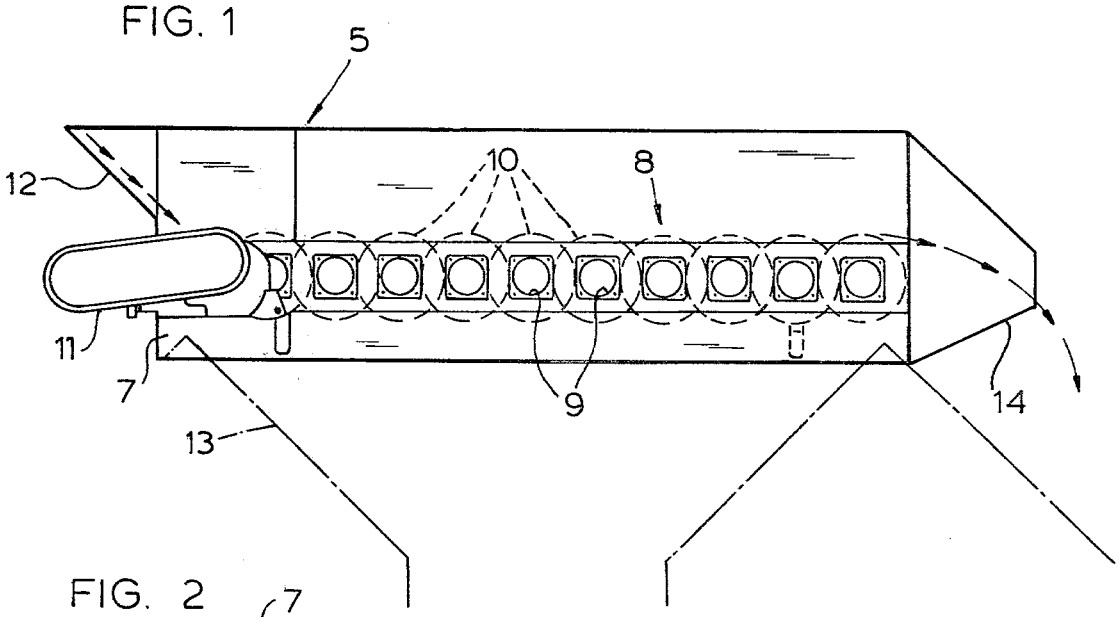
FIG. 1 is a side elevational schematic illustration of a disk screen apparatus embodying the invention.
Figure 2:
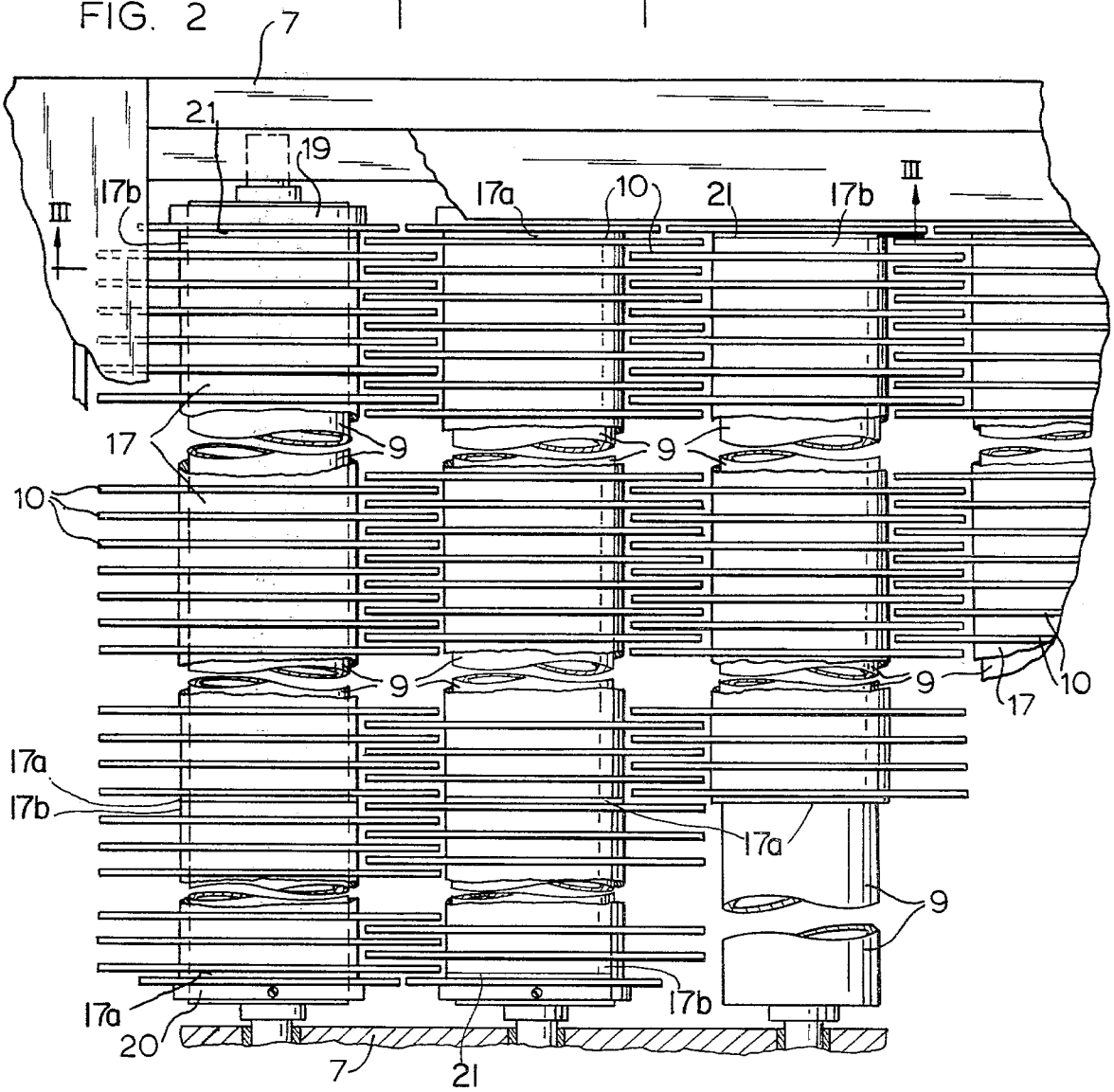
FIG. 2 is an enlarged fragmental top plan view of the screening bed of the apparatus.
Figure 3:
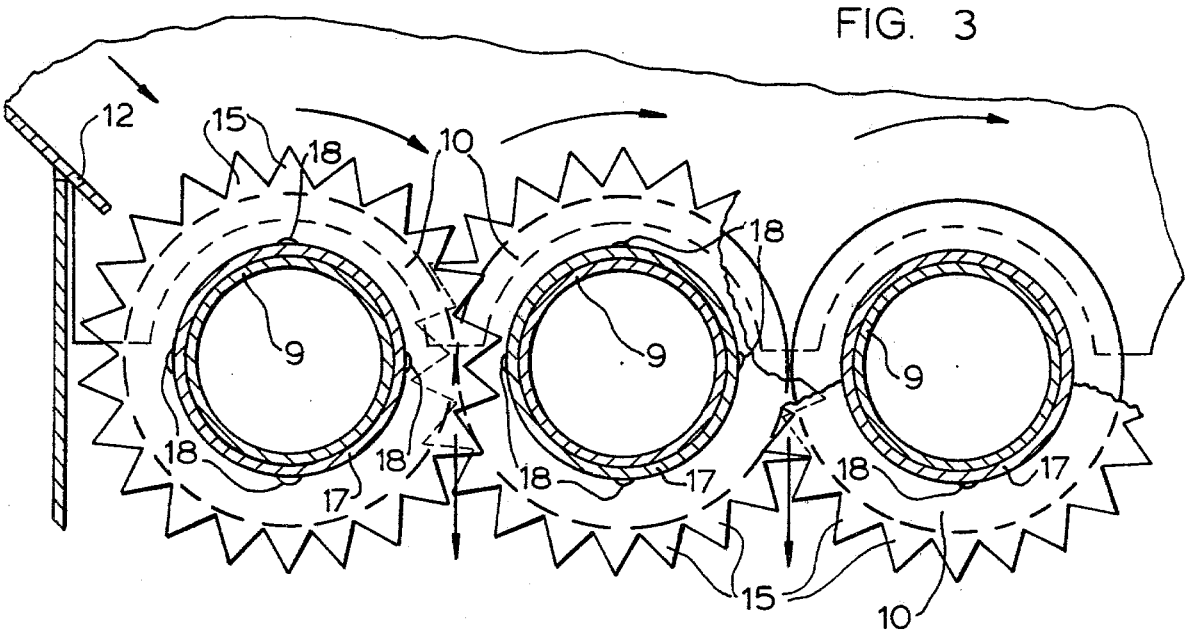
FIG. 3 is a fragmentary vertical sectional detail view taken substantially along the line III—III of FIG. 2.

Referring to FIG. 1, a disk screen apparatus 5 comprises a frame 7 supporting a screening bed 8 having a series of corotating spaced parallel shafts 9 of cylindrical perimeter and similar length and each of which has a longitudinal series of concentric screen disks 10 which interdigitate as best seen in FIG. 2 with the screen disks of the adjacent shafts. The shafts 9 are preferably hollow tubular with stub shafts **9*a* at one end and stub shafts 9*b* at the opposite end, and the stub shafts suitably journaled on the frame 7. The shafts 9 are driven in unison in the same direction, clockwise as seen in FIG. 1, by suitable drive means 11. Material such as wood pulp slurry to be screened is delivered to the infeed end of the screening bed 8 by means of a chute 12. The acceptable wood pulp fiber size particles drop with slurry water through the screening slots defined by the disks 10 and are received in a hopper 13. Wood particles which are too large to pass through the screening slots are advanced to and discharged, as indicated by directional arrows, from the rejects end of the screening bed 8 as by means of an outfeed chute 14. The screening function of the disks 10 is enhanced by a uniform generally saw tooth configuration of the outer perimeters of the disks 10 provided by teeth 15 (FIG. 3) which are somewhat shorter than the extent of interdigitation of the disks. Since the disks 10** rotate in a common direction, efficient screening out of oversize particles and advance of the oversize particles to the discharge end of the screening bed are accomplished.

For optimum results, care must be exercised to assure that the screening slot spacing between the disks 10 be as accurate as practicable. To attain such accuracy, the disks 10 are desirably mounted by sets concentrically and in axially extending relation on tubular hubs 17 each comprising a sleeve having an inside diameter throughout its length complementary to and adapted for slidable concentric engagement with the perimeter of the shafts 9. For this purpose, the disks 10 are centrally apertured to receive the hubs 17 therethrough. The disks 10 are attached in substantially accurately spaced relation to one another axially along the hubs 17 in any suitable manner, as for example, by means of welding 18. In a desirable arrangement, the hubs 17 are in such lengths shorter than the shafts 9 that a plurality of the hubs 17 each carrying a set i.e. plurality of the disks 10 can be releasably slidably mounted in end-to-end abutting relation and engaged throughout their lengths concentrically on each of the shafts 9. Each of the hubs 17 and the set of disks 10 carried thereby is thus in the form of a module which together with the companion modules mounted on the same shaft 9 provide a continuous set or array of the disks 10 in substantially accurately uniformly spaced relation to one another throughout the module assembly along the shaft. This arrangement has numerous advantages among which may be mentioned that the screening slots can be accurately controlled. Manufacturing costs are greatly reduced as compared to mounting of the disks directly on the shaft. Various widths of disk screens can be calculated by multiples of the module length. The modules lend themselves to rapid bench production methods and avoid hand-fitting as has been practiced heretofore. The slot width of any given screen can be readily changed by replacing the modules, without replacing the shafts. Damaged disks can be readily replaced by simply changing the affected module or modules in the field.

In one embodiment, each of the shafts 9 carries corotatively thereon the desired number of the hub and disk modules in end-to-end relation, with means such as end clamps 19 and 20 at the opposite ends of the series of modules, and means are provided for axially orienting the hub sleeves 17 on each of the shafts 9 for maintaining interdigitated spaced relation of the disks 10 of each assembly with the disks 10 of each adjacent assembly. To this end, the hubs 17 may be of identical length having one end 17*a* of each hub extending a shorter distance beyond the adjacent disk 10 on the hub than the opposite end 17*b* extends beyond the disk 10 adjacent thereto on the hub, but the combined extents of the ends 17*a* and 17*b* being equal to the fixed spacing between the disks 10. The ends 17*a* and 17*b* are oriented oppositely on the alternate shafts 19 as shown in FIG. 2. Suitable spacers may be used between the longer ends 17*b*and the end clamps 19 and 20 of the alternate shaft and module assemblies to properly orient the modules of one shaft relative to the adjacent shaft or shafts for proper interdigitating of the disks 10. The diameters and module lengths of the hubs 17 may be as desired depending on the size of the screening table and the character of the fibrous slurry material to be processed. For example, the shaft diameter to be accommodated may range from four to near nine inches and the module length may range from about eight to fourteen inches. Depending on the character of the wood pulp to be processed, the disks 10 may range from about 6 to about 19 inches outside diameter, and may range from as many as twenty-five of the smaller diameter disks on a hub of about one foot length to as few as five or six disks on a hub of about eight inches in length carrying the largest diameter disks.

Figure 4:
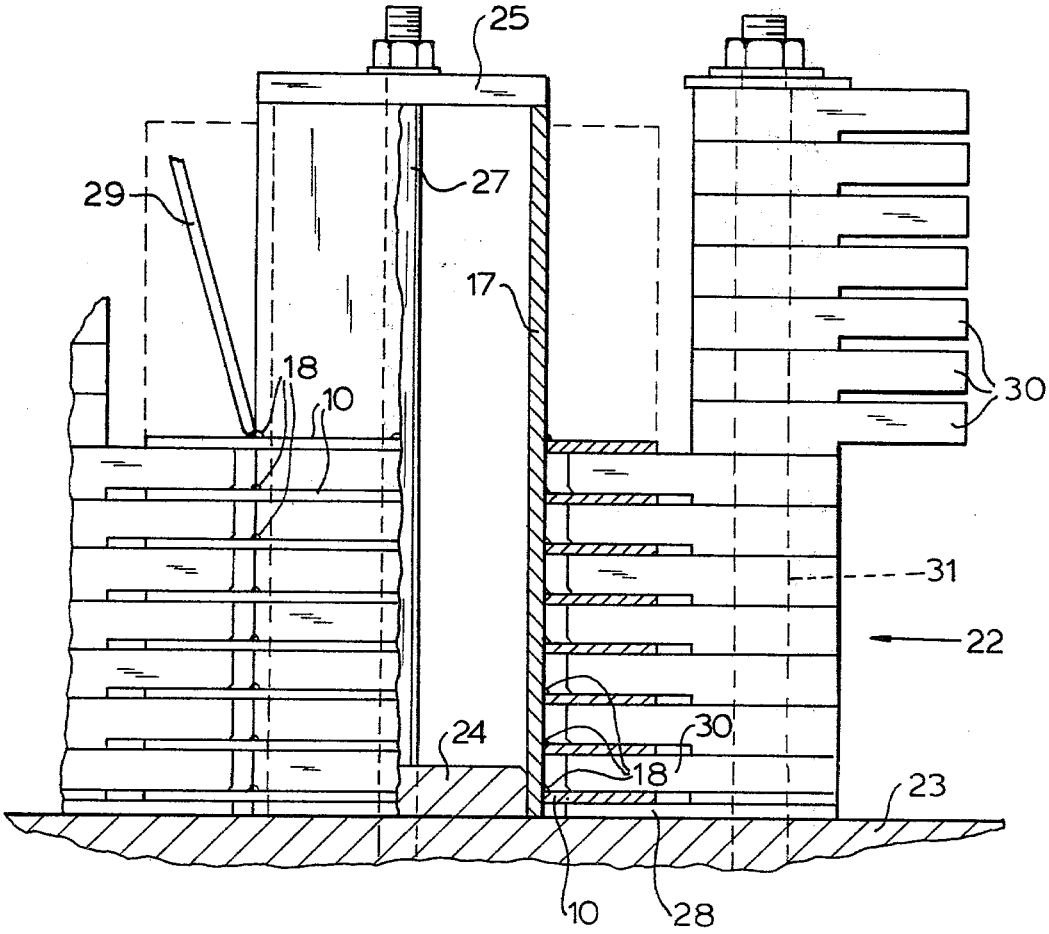
FIG. 4 is a view showing steps in the method of making a screen disk module pursuant to the present invention.

For accurately mounting the disks 10 on the respective hubs 17, the procedure exemplified in FIG. 4 may be used. For this purpose, a welding jig 22 may be equipped to receive one of the tubular hubs 17 endwise on a base 23 having a centering boss 24 to fit in one end of the hub, while a clamping plate 25 secured as by means of a bolt 27 retains the hub 17 accurately in place in the jig. Each successive disk 10 is then adapted to be accurately located and attached to the hub 17 starting at the base end of the hub as retained in the jig, and working toward the opposite end. The first of the disks 10 will be received on a first or base jig shoulder 28 and attachment of the disk then effected as by means of the welding 18 applied in any suitable manner as for example, by means of a welding rod 29. Each successive of the disks 10 is then accurately located by gauging means such as respective sets of gauging fingers 30 adapted to be successively swung from inactive position about a pivot such as may be provided by a shaft 31 into active position overlying the next preceding disk 10 that has been attached to the hub 17. This procedure continues step-by-step with each successive disk 10 until the full set of disks has been attached to the hub. Although the fixture of jig 22 has been shown in a relatively simple, easily manually operated form, it will be obvious that such a fixture or jig, or its equivalent, can be easily automated for accelerated production if desired.

Figures 5, 6:
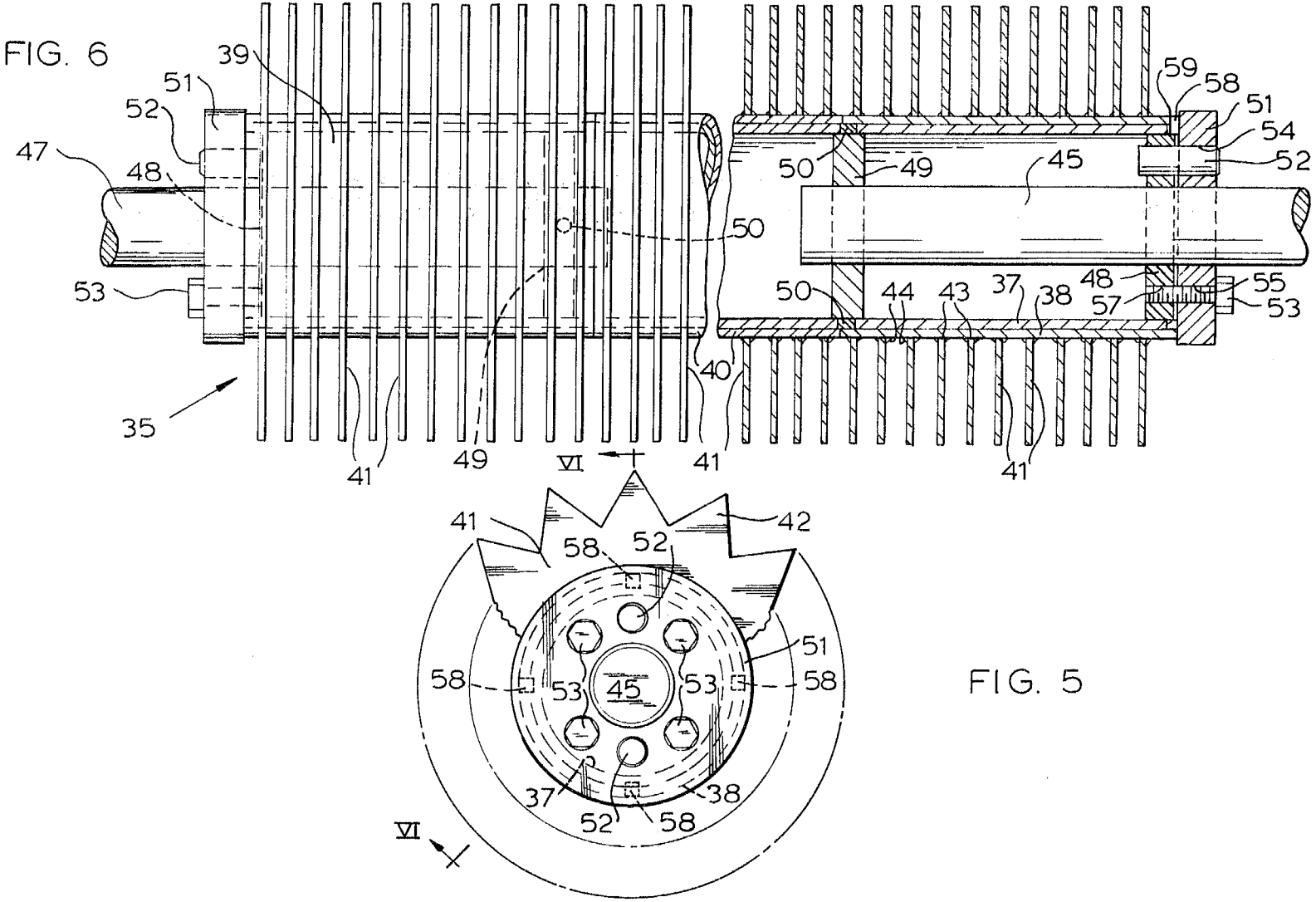
FIG. 5 is an end elevation view of a typical shaft and disk screen assembly.
FIG. 6 is a fragmental elevational view and partially in section taken along the line VI—VI of FIG. 5.

In a preferred embodiment as represented in FIGS. 5 and 6, a screen disk assembly 35 comprises a hollow tubular shaft 37 of any desired practical length having mounted corotatively thereon a tubular hub 38 mounted on one end portion of the shaft, a tubular hub 39 mounted on the opposite end portion of the shaft, and tubular hubs 40 mounted on the shaft between the end hubs 38 and 39. All of the hubs 38, 39 and 40 carry uniformly spaced screen disks 41 provided with dentate perimters 42. Each of the screen disks 41 is of ring form having a central aperture 43 through which the respective hub is received and to which hub the disk is fixedly secured as by means of welding 44 in substantially accurately spaced relation to the adjacent disks.

In order to attain interdigitation of the disks 41 while utilizing a standard length shaft for any given width of screening bed, the endmost disk carrying hubs 38 and 39 are adapted to be alternatively mounted on the respectively opposite end portions of the shaft 37 and are provided with differential numbers of disks. For example, as shown, the hub 38 may carry eleven of the disks 41, while the hub 39 may carry twelve of the disks 41, and each of the intermediate disk carrying hubs may carry an identical number of the disks 41, such as eleven. Through this arrangement, by having the hubs 38 and 39 alternated on each alternate shaft 37 in an array of the shafts cooperatively disposed in the screening bed, such as the bed 8 represented in FIG. 1, substantially accurate interdigitation of the disks 41 can be attained.

In the assembly 35, the disk-carrying hubs are aligned in end-to-end abutting relation and the opposite ends of the alignment are clamped to secure the assembly corotatively. To this end, the shaft 37 has a smaller diameter stub shaft 45 at one end and a coaxial smaller diameter stub shaft 47 at the opposite end. Each of the stub shafts 45 and 47 is desirably similarly mounted fixedly by means of a centering disk 48 secured as by means of welding intermediately the ends of the stub shaft. The disk 48 is dimensioned to engage closely within the respective end of the hollow shaft 37 and is secured fixedly as by means of welding, with the outer end of the disk 48 exposed at the end of the hollow shaft. For stability, the inner end portion of each of the stub shafts 45 and 47 projects to a substantial extent inwardly from the associated centering disk 48 and is secured in stabilized relation by stabilizer means 49 secured as by means of welding 50 to the shaft 37.

To effect secure corotative attachment of the string of disk modules on the shaft, the overall length of the string of modules is designed to be slightly longer than the length between the outer faces of the stub shaft securing and centering disks 48. Therefore, clamping ring disks 51 engage slidably about the stub shafts 45 and 47 and are adapted to be drawn up toward the opposite ends of the disk hub string in corotational securing relation. For this purpose, the centering disks 48 carry means for securing the clamping disks 51 in place, comprising respective pairs of locating pins 52, and sets, such as four cap screws 53. The pins 52 are rigidly affixed to the centering disks 48 and project outwardly therefrom, and the clamping disks 51 have matching pin holes 54 through which the pins 52 are received. Each of the clamping disks has screw holes 55 therethrough to accommodate the shanks of the cap screws 53, and the centering disks 48 have matching tapped screw holes 57. Thus, by drawing up the clamping disks 51 by means of the cap screws 53, against the outer ends of the disk hub string firmly secures the assembly.

For indexing purposes and for improved torquing, the compressing or clamping disk 51 at one end of the assembly has on the outer margin of its inner face, indexing and keying means comprising a plurality of circumferentially spaced, herein four keying lugs 58 which may be of square cross-section and which are adapted to engage in respective keying notches 59 in the outer end of the hub 38. As is apparent from FIG. 6, the width of the notched outer end of the hub 38 is greater by about one-half than the width between the disks 41. Such greater width is substantially the equivalent of the spacers 21 in FIG. 2 and serves a similar purpose. At its inner end, the hub 38 which matches the width of the ends of the hubs 40, i.e. one-half the width between the disks 41. The hub 39 has no end notches, but its inner end width matches the widths of the ends of the hubs 40 and the inner end of the hub 38. The outer end width of the hub 39 is about the same as the between-disk spacing width. These relationships provide means for axially orienting the hub sleeves 38, 39 and 40 on each shaft of the alternate assemblies 35 in a screening bed relative to the hub sleeves on each adjacent shaft for maintaining interdigitated spaced relation of the disks 41 of each assembly with the disks of each adjacent asembly. On each alternate one of the assemblies 35 in a screening bed, the clamping disk 51 having the lugs 58, as well as the hub 38 and the hub 39 will, of course, be alternated, so as to attain proper interdigitating of the disks 41.

Either of the stub shafts 45 or 47 may be provided with suitable means for keying it to drive means such as a gear train, sprocket, or the like. The other of the stub shafts may be provided with means for idling retention relative to the machine frame.

By constructing the screen disk modules according to accurate standards, assembly of the modules on the shafts by sliding the same into place, and then locking the modules on the shafts can be quickly and easily effected with adequate accuracy because the modules themselves are constructed with substantial accuracy. Should there by chance be any slight variance in hub length which might interfere with substantial accuracy of screen spacing between the screen disks, such variance can be readily and easily adjusted by means of the end spacer rings or shim rings, end grinding, or the like. In general, however, any such variance should be avoidable because of the substantial accuracy with which the disks can be mounted on and attached to the hubs and the substantial accuracy to which the hub lengths can be standardized.

It will be understood that variations and modifications may be effected without departing from the spirit and scope of the novel concepts of this invention.

I claim as my invention:

1. A disk screen apparatus comprising a screening bed having a series of corotating spaced parallel elongate shafts each of which has thereon a longitudinal series of concentric screen disks which interdigitate in axially spaced relation with the screen disks on the adjacent shafts, and comprising:

each of said shafts having a cylindrical perimeter and a similar length;

a plurality of tubular screen disk modules each of which comprises an elongate tubular hub sleeve substantially shorter than said shafts, but each sleeve having a complementary inside diameter throughout its length for slidable engagement on said shaft perimeters;

each shaft having thereon an assembly of a plurality of said modules with the hub sleeves releasably slidably engaged throughout their lengths concentrically in endwise abutment with each other on and about the shaft perimeter;

each of said hub sleeves carrying in fixed radially extending relation thereabout a plurality of said screen disks in substantially accurately uniformly axially spaced relation to one another throughout each assembly on each of said shafts;

means releasably clamping the hub sleeves of each assembly in endwise engagement with one another and in corotative relation on and with each shaft;

and means for axially orienting said hub sleeves on each shaft relative to the hub sleeves on each adjacent shaft for maintaining interdigitated spaced relation of the disks of each assembly with the disks of each adjacent assembly.

2. Apparatus according to claim 1, wherein said disks are provided with central apertures through which said hub sleeves extend, and means attaching said disks fixedly to said hub sleeves.

3. Apparatus according to claim 2, wherein said means securing the disks to the hubs comprise welding.

4. Apparatus according to claim 1, wherein said tubular hub sleeve of the screen disk modules are of predetermined length, and each module on each shaft carries the same number of disks, except one of the modules on each shaft which carries one disk more than the remaining modules on that shaft, the modules carrying the one disk more being located on alternate opposite ends of the shafts, whereby to attain the interdigitation of the disks.

5. Apparatus according to claim 4, including means for indexing the orientation of the hubs on the alternate shafts.

6. Apparatus according to claim 1, including keying means between the clamping means at one end of the assembly of modules on each shaft and the end module at said one end.

7. Apparatus according to claim 1, wherein each of said shafts is a hollow tubular shaft, and each hollow tubular shaft has concentric smaller diameter stub shafts at its opposite ends.

8. A disk screen apparatus comprising a screening bed having a series of corotating spaced parallel shafts each of which has a longitudinal series of concentric screen disks which interdigitate with the screen disks of the adjacent shafts, and comprising:

each of said shafts carrying concentrically thereon a plurality of tubular screen disk modules of predetermined length and disposed in end-to-end relation;

each module comprising a tubular hub carrying in radially extending relation thereon a set of said disks in substantially accurately spaced relation to one another axially along said hub;

and each module on each shaft carrying the same number of disks, except one of the modules on each shaft which carries one disk more than the remaining modules on that shaft, the modules carrying the one disk more being located on alternate opposite ends of the shafts, whereby to attain the interdigitation of the disks.

9. Apparatus according to claim 8, including means for indexing the orientation of the hubs on the alternate shafts.

10. A disk screen apparatus comprising a screening bed having a series of corotating spaced parallel elongate shafts each of which has thereon a longitudinal series of concentric screen disks which interdigitate in axially spaced relation with the screen disks on the adjacent shafts, and comprising:

each of said shafts being of a selected diameter of about 4 to 9 inches and each having a cylindrical perimeter and being of similar length;

a plurality of tubular screen disk modules each of which comprises an elongate tubular hub sleeve of from 8 to 14 inches in length and substantially shorter than said shafts, but each sleeve having a complementary inside diameter throughout its length for slidable engagement on said shaft perimeters;

each shaft having thereon an assembly of a plurality of said modules with the hub sleeves releasably slidably engaged throughout their lengths concentrically in endwise abutment with each other on and about the shaft perimeter;

each of said hub sleeves carrying in fixed radially extending relation thereabout a plurality of from 5 to 6 large diameter screen disks on an about 8 inch length of sleeve to 25 screen disks of smaller diameter on one foot length of the hub sleeves, and the screen disks being in substantially accurately uniformly axially spaced relation to one another throughout each assembly on each of said shafts;

means releasably clamping the hub sleeves of each assembly in endwise engagement with one another and in corotative relation on and with each shaft;

and means for axially orienting said hub sleeves on each shaft relative to the hub sleeves on each adjacent shaft for maintaining interdigitated spaced relation of the disks of each assembly with the disks of each adjacent assembly.

11. A method of making a disk screen apparatus comprising a screening bed having a series of corotating spaced parallel elongate shafts each of which has thereon a longitudinal series of concentric screen disks which interdigitate in axially spaced relation with the screen disks on the adjacent shafts, the method comprising:

providing each of said shafts with a cylindrical perimeter and similar length;

providing a plurality of tubular screen disk modules each comprising an elongate tubular hub sleeve substantially shorter than the shafts, but providing each sleeve with a complementary inside diameter throughout its length for slidable engagement on the shaft perimeters;

releasably slidably engaging the hub sleeves of a plurality of said modules throughout their lengths into an assembly on each shaft and abutting the sleeves in endwise relation to each other concentrically on and about the shaft perimeters;

prior to assembling said modules on said shaft, mounting on each of said hub sleeves in fixed radially extending relation therebout a plurality of said screen disks and in such mounting arranging the disks for being in substantially accurately uniformly axially spaced relation to one another throughout each assembly on each of said shafts;

releasably clamping the hub sleeves of each assembly in endwise engagement with one another and in corotative relation on and with each shaft;

and axially orienting said hub sleeves on each shaft relative to the hub sleeves on each adjacent shaft and maintaining interdigitated spaced relation of the disks of each assembly with the disks of each adjacent assembly.

12. A method according to claim 11, wherein each of the disks has a central aperture, extending the hubs through the disks, and fixedly securing the disks to the hubs.

13. A method according to claim 12, which comprises welding the disks to the hubs and thereby securing them in place on the hubs.

14. A method according to claim 11, which comprises assembling said disks with said hub sleeves by holding the hub sleeves, prior to assembly with the shafts, respectively in a fixture, axially assembling said disks successively one-by-one on and about each hub sleeve by receiving the hub sleeve through a respective complementary aperture in each disk, maintaining each successive disk substantially accurately spaced from the next preceding disk by removably interposing a spacer between the disks, welding the inner perimeter of each successive disk to the hub sleeve, removing the spacers from between disks that have been welded in place on the hub sleeve, and, after all of a predetermined number of the disks have been welded to the sleeve, removing the disk-carrying hub sleeve from the fixture for assembly with a shaft.

* * * * *